US005669401A

United States Patent [19]

Mansur

[11] Patent Number: 5,669,401

[45] Date of Patent: Sep. 23, 1997

[54] GENERAL WASHER APPARATUS

[75] Inventor: Pierre G. Mansur, Miami, Fla.

[73] Assignee: Mansur Industries Inc., Miami, Fla.

[21] Appl. No.: 532,469

[22] Filed: Sep. 22, 1995

[51] Int. Cl.[6] ..... B08B 3/10

[52] U.S. Cl. ..... 134/108; 134/110; 134/105

[58] Field of Search ..... 68/18 C; 134/105, 134/107, 108, 57 R, 56 R, 58 R, 200, 166 R, 169 R, 110

[56] References Cited

U.S. PATENT DOCUMENTS

| | | | |
|---|---|---|---|
| 1,697,767 | 1/1929 | Hirst . | |
| 2,019,896 | 11/1935 | Edlich | 68/18 C |
| 2,070,204 | 2/1937 | Hetzer . | |
| 2,166,294 | 7/1939 | Hetzer | 68/18 C |
| 2,176,705 | 10/1939 | Derby | 68/18 C |
| 2,243,093 | 5/1941 | Flahive . | |
| 2,352,356 | 6/1944 | Albertson . | |
| 2,682,273 | 6/1954 | Roach . | |
| 2,698,288 | 12/1954 | Dinley, Jr. . | |
| 2,834,359 | 5/1958 | Kearney . | |
| 2,924,557 | 2/1960 | De Furia . | |
| 3,011,924 | 12/1961 | Rand . | |
| 3,070,463 | 12/1962 | Barday . | |
| 3,177,126 | 4/1965 | Charreau . | |
| 3,308,839 | 3/1967 | Barday | 134/108 |
| 3,426,555 | 2/1969 | McCutcheon et al. | 68/18 C |
| 3,543,540 | 12/1970 | Gunter | 68/18 C |
| 3,598,131 | 8/1971 | Weihe, Jr. . | |
| 3,610,260 | 10/1971 | Kearney . | |
| 3,707,404 | 12/1972 | Carlson et al. . | |
| 3,718,147 | 2/1973 | Laroche . | |
| 3,771,539 | 11/1973 | De Santis . | |
| 3,915,808 | 10/1975 | Wilcox . | |
| 3,996,949 | 12/1976 | Boynton . | |
| 4,008,729 | 2/1977 | Chizinsky . | |
| 4,051,858 | 10/1977 | Mele . | |
| 4,101,340 | 7/1978 | Rand . | |
| 4,122,861 | 10/1978 | Lee . | |
| 4,141,373 | 2/1979 | Kartanson et al. . | |
| 4,170,240 | 10/1979 | Gentry . | |
| 4,290,439 | 9/1981 | Charpentier . | |
| 4,299,663 | 11/1981 | McCord . | |
| 4,353,323 | 10/1982 | Koblenzer . | |
| 4,433,698 | 2/1984 | Blaul . | |
| 4,443,269 | 4/1984 | Capella et al. . | |
| 4,451,298 | 5/1984 | Yagishita et al. . | |
| 4,505,284 | 3/1985 | Kyatt . | |
| 4,581,133 | 4/1986 | Tomes . | |
| 4,596,634 | 6/1986 | McCord . | |
| 4,615,744 | 10/1986 | Murtha | 134/108 |
| 4,616,377 | 10/1986 | Urbani . | |
| 4,707,878 | 11/1987 | Urbani . | |
| 4,755,261 | 7/1988 | McCord et al. . | |
| 4,770,197 | 9/1988 | Prisco, Jr. et al. . | |
| 4,771,503 | 9/1988 | Urbani . | |
| 4,785,836 | 11/1988 | Yamamoto . | |
| 4,865,061 | 9/1989 | Fowler et al. . | |
| 4,874,472 | 10/1989 | Kohler . | |

(List continued on next page.)

FOREIGN PATENT DOCUMENTS

| | | |
|---|---|---|
| 662742 | 3/1929 | France . |
| 2394334 | 6/1977 | France . |
| 369641 | 12/1958 | Switzerland . |
| 290285 | 12/1928 | United Kingdom . |

*Primary Examiner*—Frankie L. Stinson
*Attorney, Agent, or Firm*—Robert M. Downey, P.A.

[57] ABSTRACT

An apparatus for washing general parts and other articles with a liquid cleaning solution, the apparatus including a basin and a wash area defining an upper chamber, a hood to enclose the upper chamber, a pump in the basin for recirculating the cleaning solution to the wash area for washing the parts and articles therein, a lower holding tank for containing a charge of purified cleaning solution, and a second pump for circulating a portion of the charge of purified cleaning solution to the wash basin for use during washing operations. Heating elements in the basin boil the cleaning solution therein, with the hood closed, and a vacuum pump creates a negative pressure in the upper chamber, drawing vapors through a condenser to yield purified cleaning solution which is directed to the clean solution holding tank for subsequent transfer to the basin.

15 Claims, 2 Drawing Sheets

U.S. PATENT DOCUMENTS 4,879,004 11/1989 Oesch et al. .
4,929,312 5/1990 Westcott .
5,056,174 10/1991 Hagiwara ..... 68/18 C
5,069,755 12/1991 Durr et al. .
5,095,925 3/1992 Elledge et al. .
5,180,438 1/1993 Hockh et al. .
5,193,561 3/1993 Robb et al. .
5,232,299 8/1993 Hiss .
5,240,507 8/1993 Gray et al. .
5,273,589 12/1993 Griswold et al. ..... 134/108
5,301,701 4/1994 Nafzgier ..... 134/108
5,318,056 6/1994 Kusz et al. .
5,357,771 10/1994 Schaal .
5,377,705 1/1995 Smith, Jr. et al. .
5,402,806 4/1995 Hakeem et al. .
5,415,193 5/1995 Taricco .
5,438,025 8/1995 Gray et al. ..... 134/108
5,469,876 11/1995 Gray et al. ..... 134/108

GENERAL WASHER APPARATUS

BACKGROUND OF THE INVENTION

1. Field of the Invention

This invention relates to an apparatus for washing articles with a liquid cleaning solution, and more particularly to a parts washer apparatus structured to recycle contaminated, dirty cleaning solution to produce fresh, non-contaminated cleaning solution on a regular basis for reuse during washing operations.

2. Description of the Related Art

In many industries, including the automotive, aviation and marine industries, it is often necessary to wash a wide variety of parts, equipment, and other articles with a liquid cleaning solution in order to remove grease, oil, dirt, and other contaminants.

Presently, the most commonly used means to wash small parts, equipment, and other articles is a sink which is removably supported on the top of a drum filled with cleaning solvent. The solvent is pumped to a spout in the sink, whereupon the discharged solvent is used to rinse parts in the sink. After washing, the solvent is drained back into the drum for subsequent use during washing operations. In a short period of time, the charge of cleaning solvent contained in the drum, which is reused for washing, becomes contaminated with oils, grease, dirt, particulate, and other contaminants which are rinsed from the parts being cleaned. The contaminated solvent is continuously used during washing operations until the drum of contaminated solvent is replaced with a new drum containing fresh solvent. The replacement of solvent is ordinarily provided by a service, which removes the contaminated drum and replaces a new drum of fresh solvent on a replacement cycle which may be every four to eight weeks. The drum of contaminated solvent, which is removed, must be disposed of or recycled by the service in a manner which complies with EPA guidelines. Accordingly, large volumes of contaminated cleaning solvent are constantly being transported to a central treatment facility for disposal. This procedure is inefficient, costly, and time-consuming, and often fails to comply with the EPA contaminant disposal guidelines. Further, the users of this service find themselves performing parts cleaning operations using dirty, contaminated solvent between scheduled solvent replacement dates.

To solve this problem, the inventor hereof has developed a number of general parts washing apparatus and other industrial washing equipment which is specifically structured for the integrated recycling of cleaning solution in the apparatus, thereby eliminating the need for disposal and replacement of large volumes of cleaning solution. A disclosure of these washing apparatus, developed by the present inventor, can be found in U.S. Pat. Nos. 5,349,974 and 5,388,601, as well as other pending U.S. patent applications. These previously developed parts washing apparatus all include at least one cleaning solution holding tank and a separate distillation chamber, wherein the cleaning solution in the holding tank, once contaminated, is released into the distillation chamber during a recycling process. These various apparatus have been found to be extremely efficient and useful in solving the above-referenced problems relating to the disposal of contaminated cleaning solution. However, it has been subsequently discovered by the inventor hereof that, by eliminating the distillation chamber and boiling the contaminated solution in a wash basin instead, thereby recycling a smaller volume of cleaning solution and reducing the time required to complete the recycling process, a more compact and economical washing apparatus can be produced for use in certain industrial environments.

SUMMARY OF THE INVENTION

The present invention is directed to a compact general washing apparatus for washing general parts and articles with a cleaning solution, wherein the apparatus is structured to provide integrated recycling of the cleaning solution to provide pure, fresh cleaning solution on demand.

More particularly, the present invention is directed to a compact general washer apparatus which is structured to provide for integrated and rapid recycling of contaminated, dirty cleaning solution (including solvents and aqueous cleaning solutions) on a regular basis to provide fresh, non-contaminated solution for cleaning operations. Accordingly, the general washer apparatus eliminates the need for regular replacement and disposal of contaminated cleaning solution. The compact general washer further provides for rapid and efficient integrated recycling of cleaning solution, thereby eliminating long periods of "down time" during the recycling process.

In accordance with the general washing apparatus of the present invention, there is provided a cabinet structure for housing an upper chamber, including a wash basin and a washing area, and a lower portion including a clean solution holding tank. The wash basin and work area in the upper portion can be separated by a metal grating or mesh floor for placing parts and other articles thereon. Alternatively, the grating can be removed for soaking the articles in the cleaning solution contained in the basin.

A first pump transfers cleaning solution from the basin through a discharge spout, hose, and/or spray nozzles and into the wash area. A second pump transfers a portion of the purified cleaning solution contained in the clean solution holding tank to the wash basin after recycling contaminated solution in the basin. A hood on the upper portion is movable between an open position during washing operations, and a closed position during the recycling process to seal off the upper chamber (including the washing area and wash basin).

During the recycling process, a vacuum creates a negative pressure in the upper chamber, with the hood closed, while heating elements in the wash basin boil the cleaning solution therein to create vapors and separate contaminants therefrom. The vapors are directed through a condenser to yield purified, condensed liquid cleaning solution which collects in a receiving tank. The purified solution is subsequently directed into the clean solution holding tank. Thereafter, a portion of the purified cleaning solution in the holding tank is transferred to the wash basin for use during subsequent washing operations.

Accordingly, with the foregoing in mind, it is a primary object of the present invention to provide a compact general washing apparatus for use in cleaning parts and other articles to remove oil, grease, and other contaminants therefrom, wherein the apparatus includes means for recovering and recycling cleaning solution so as to provide a user with "on demand" pure cleaning solution on a regular basis for washing operations.

It is still a further object of the present invention to provide a compact general washing apparatus, as described above, which is structured to provide for on-site, integrated recycling of cleaning solution, thereby eliminating the need for transport and/or disposal of large volumes of contaminated cleaning solution.

It is a further object of the present invention to provide a compact general washing apparatus for integrated recycling of cleaning solution therein, and including a chamber which functions as both a distillation chamber and wash basin, thereby eliminating the need to transfer contaminated cleaning solution to a separate distillation chamber and providing for rapid and efficient integrated recycling of cleaning solution in a compact apparatus.

These and other objects and advantages of the present invention will be more readily apparent in the description which follows.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 2:
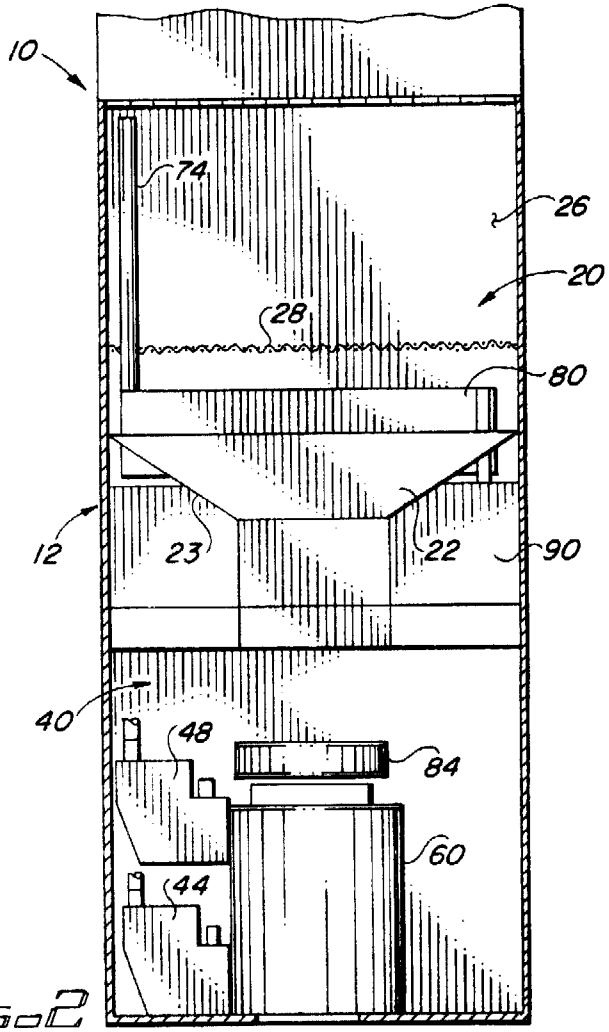
FIG. 2 is a front elevation, in partial section, illustrating the general washer apparatus.
Figure 1:
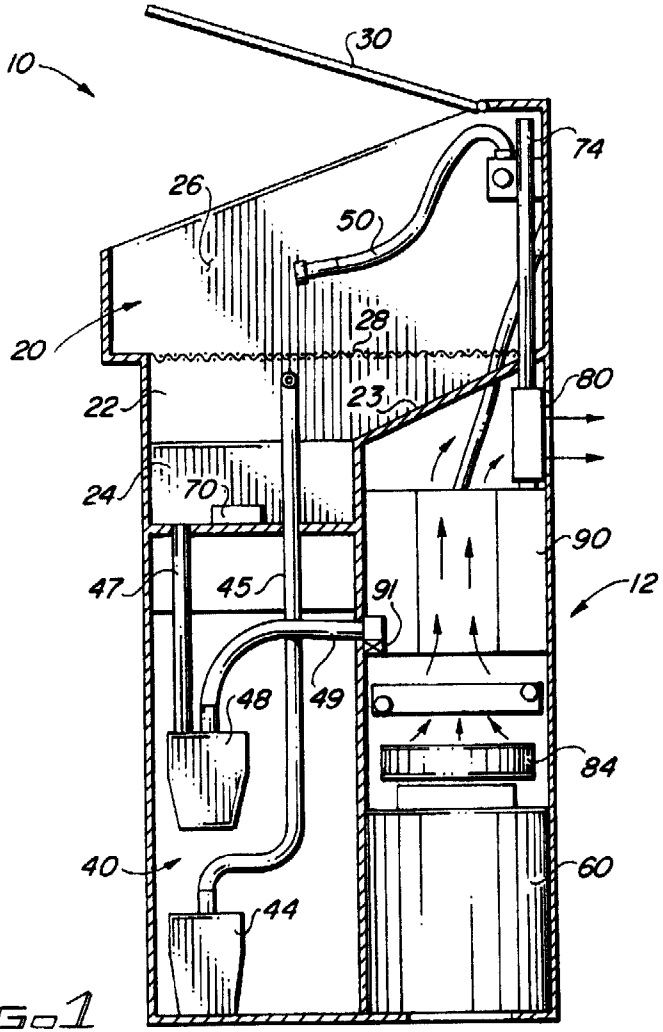
FIG. 1 is a side elevation, shown in partial section, illustrating the general washer apparatus of the present invention.

Referring to FIGS. 1 and 2, there is generally illustrated the general washer apparatus 10 which is specifically structured to perform integrated recycling of liquid cleaning solution in a rapid and efficient manner. The apparatus 10 includes a vertically upstanding cabinet structure 12 adapted to support and house the component elements of the apparatus 10. An upper chamber 20 of the apparatus 10 includes a wash basin 22, and an upper work area 26 for washing articles therein. The basin 22 and work area 26 are separated by a grating or mesh floor 28 which is specifically structured and disposed to prevent articles from falling down into the basin 22. The basin is provided with a sloped floor 23 so that the cleaning solution which is deposited in the basin 22 is directed towards a bottom portion 24 thereof. A hood 30, hingedly attached to the cabinet 12, includes a handle 32 to facilitate movement between an open position and a closed position relative to an open top of the upper chamber 20. The hood 30 is normally left open during washing operations so that the user has unobstructed access to the work area 26 to wash articles therein. During periods of non-washing or recycling of cleaning solution, the hood 30 is closed so that the combined upper work area 26 and basin 22 become a sealed, enclosed chamber 20.

Figure 3:
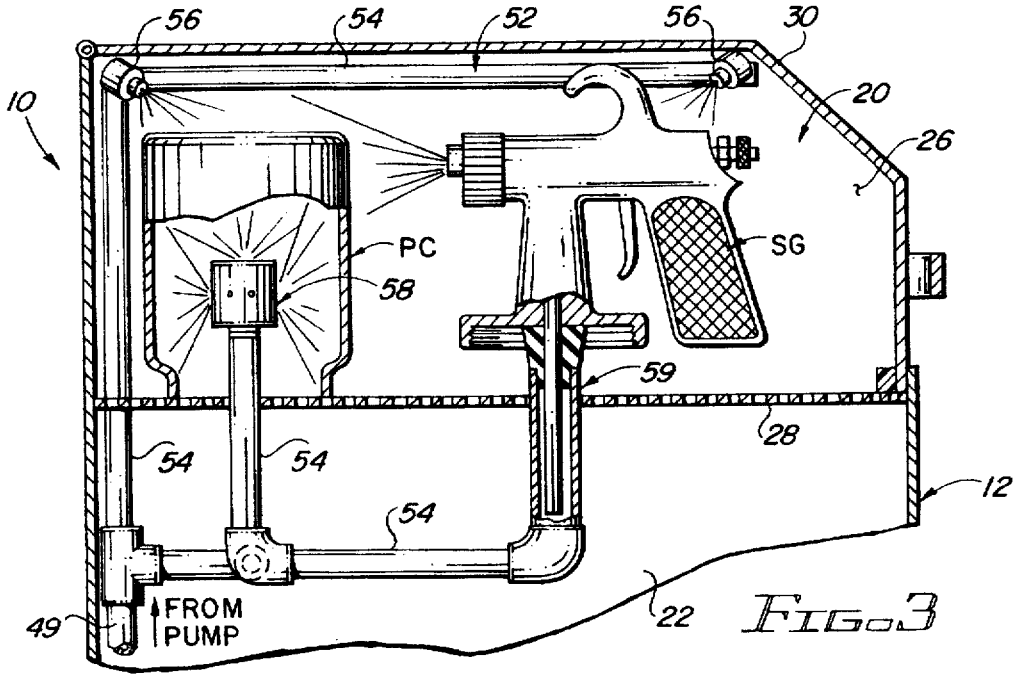
FIG. 3 is an isolated view, in partial section, of the upper chamber of the washer apparatus illustrating a paint spray gun washing assembly fitted therein for cleaning the interior and exterior surfaces of paint spraying equipment.
Figure 4:
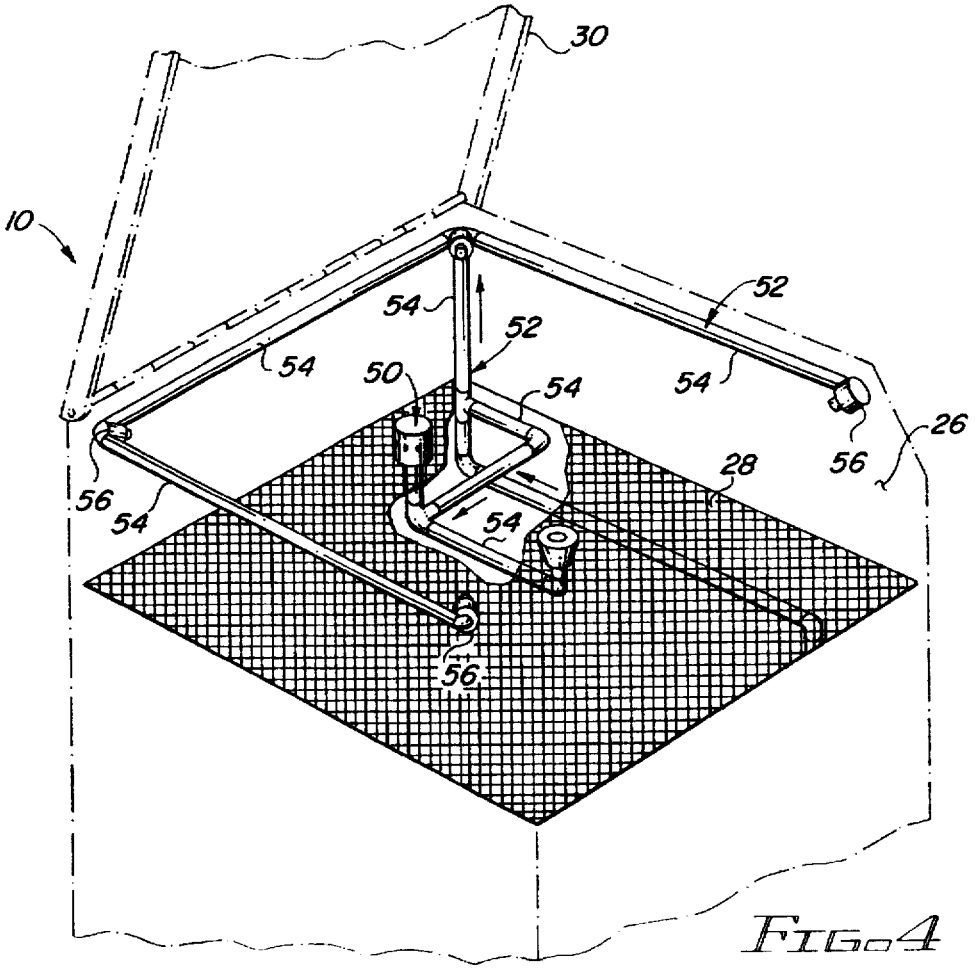
FIG. 4 is a perspective diagram of the paint spray gun washing assembly including a plurality of spray nozzles and spray heads.

Fresh, purified cleaning solution is contained in a clean solution holding tank 40. A portion of the cleaning solution is transferred from the holding tank 40 to the wash basin 22 by a transfer pump 44, through transfer line 45. The solution transferred to the basin is thereafter recirculated in the upper chamber 20 by a wash pump 48. A return conduit 47 delivers the solution from the wash basin 22 to wash pump 48. From the pump 48, the solution is delivered under pressure through a main supply conduit 49 and is discharged from a spout, hose, nozzles, or other discharge means 50 into the work area 26 for cleaning articles therein. As seen in FIGS. 3 and 4, the discharge means 50 may further include a retro-fit nozzle assembly 52 or interchangeable nozzle fittings to accommodate various washing needs, such as washing paint spray guns SG and paint cans PC or objects having internal surfaces and crevices to be cleaned. In this instance, the nozzle assembly may include a plurality of branch conduits 54 extending from the main supply conduit 49 and leading to spray nozzles 56 and spray heads 58, 59 positioned at various locations through the upper work area 26. After discharge into the work area 26, the cleaning solution then returns to the basin 22 for reuse. Once the cleaning solution in the basin 22 becomes substantially contaminated with grease, oils, dirt, and other contaminants, the hood 30 is closed to seal off the upper chamber 20 (including the work area and wash basin) and a vacuum pump 60 is activated to create a negative pressure in the upper chamber of the apparatus.

At least one heating element 70 is mounted in heat transferring relation within the wash basin 22 and is activated during the recycling process to boil the contaminated cleaning solution therein, creating vapors which are directed upwardly through the enclosed upper chamber 20 and through a tube 74, or other passageway, leading to a condenser 80. The vacuum pump 60 further drives a fan 84 to create an air flow, as indicated by the arrows in FIG. 1, past the condenser 80 to cool the vapors therein. After condensing to a liquid state, the purified cleaning solution is directed from the condenser 80 to a receiving tank 90. From the receiving tank 90, the purified cleaning solution is released through a transfer passage into the clean solution holding tank 40. The transfer passage includes a valve 91 which opens to release the clean solution into holding tank 40. A portion of the purified cleaning solution in the clean solution holding tank 40 is thereafter transferred by the pump 44 to the wash basin 22 for subsequent use during washing operations.

While the invention has been shown and described in what is considered to be a preferred and practical embodiment thereof, it is recognized that departures may be made within the spirit and scope of the following claims which, therefore, should not be limited except within the doctrine of equivalents.

Now that the invention has been described,

What is claimed is:

1. An apparatus for washing articles with a cleaning solution comprising:

an upper portion including an upper chamber, said upper chamber including a wash basin, a hood movable between an open position and a closed position to seal and enclose said upper chamber and a work area defined between said hood and said wash basin, a lower portion including a clean solution holding tank for containing a non-contaminated, predetermined charge of the cleaning solution therein, means for transferring at least a portion of the cleaning solution in said clean solution holding tank to said wash basin, discharge means at said upper portion for discharging the cleaning solution into said work area, means for transferring the cleaning solution in said wash basin to said discharge means, means for heating the cleaning solution in said wash basin to produce vapors and to separate contaminants therefrom, and condensing means for condensing the vapors to yield purified, condensed, liquid cleaning solution.

2. An apparatus as recited in claim 1 further including vacuum means for creating a negative pressure in said upper chamber of said upper portion when said hood is in the closed position.

3. An apparatus as recited in claim 1 further including means for returning the purified liquid cleaning solution from said condenser to said clean solution holding tank.

4. An apparatus as recited in claim 3 wherein said means for returning the purified liquid cleaning solution includes a receiving tank interconnected in fluid communication between said condensing means and said clean solution holding tank and being structured to contain a predetermined volume of the purified cleaning solution therein prior to transfer to said clean solution holding tank.

5. An apparatus as recited in claim 1 wherein said discharge means includes a hose.

6. An apparatus as recited in claim 1 wherein said discharge means includes a spout.

7. An apparatus as recited in claim 1 wherein said discharge means includes at least one spray nozzle.

8. An apparatus for washing articles with a cleaning solution comprising:

an upper portion including an upper chamber, said upper chamber including a wash basin, a hood movable between an open position and a closed position to seal and enclose said upper chamber and a work area defined between the hood and said wash basin, a lower portion including a clean solution holding tank for containing a non-contaminated, predetermined charge of the cleaning solution therein, first pump means for transferring at least a portion of the cleaning solution in said clean solution holding tank to said wash basin, discharge means at said upper portion for discharging the cleaning solution into said work area, second pump means for transferring the cleaning solution in said wash basin to said discharge means, solution heating means for heating the cleaning solution in said wash basin to produce vapors and to separate contaminants therefrom, condensing means for condensing the vapors to yield purified, condensed, liquid cleaning solution, and return means for returning the purified liquid cleaning solution from said condenser to said clean solution holding tank.

9. An apparatus as recited in claim 8 further including vacuum means for creating a negative pressure in said upper chamber of said upper portion when said hood is in the closed position.

10. An apparatus as recited in claim 8 wherein said means for returning the purified liquid cleaning solution includes a receiving tank interconnected in fluid communication between said condensing means and said clean solution holding tank and being structured to contain a predetermined volume of the purified cleaning solution therein prior to transfer to said clean solution holding tank.

11. An apparatus as recited in claim 8 wherein said discharge means includes a hose.

12. An apparatus as recited in claim 8 wherein said discharge means includes a spout.

13. An apparatus as recited in claim 8 wherein said discharge means includes at least one spray nozzle.

14. An apparatus for washing articles with a cleaning solution comprising:

an upper portion including an upper chamber, said upper chamber including a wash basin, a hood movably attached to said upper portion and movable between an open position and a closed position, said hood sealing and enclosing said upper chamber when in said closed position, and a work area defined between said hood and said wash basin, a lower portion including a clean solution holding tank for containing a non-contaminated, predetermined charge of the cleaning solution therein, first pump means for transferring at least a portion of the cleaning solution in said clean solution holding tank to said wash basin, discharge means at said upper portion for discharging the cleaning solution into said work area, second pump means for transferring the cleaning solution in said wash basin to said discharge means, heating means for heating the cleaning solution in said wash basin to produce vapors and to separate contaminants therefrom, said heating means including at least one heating element positioned and disposed in heat transferring relation to said cleaning solution in said wash basin, condensing means for condensing the vapors to yield purified, condensed, liquid cleaning solution, and return means for returning the purified liquid cleaning solution from said condenser to said clean solution holding tank and including a receiving tank interconnected in fluid communication between said condensing means and said clean solution holding tank and being structured to contain a predetermined volume of the purified cleaning solution therein prior to transfer to said clean solution holding tank.

15. An apparatus as recited in claim 14 further including vacuum means for creating a negative pressure in said upper chamber of said upper portion when said hood is in the closed position.

* * * * *